US010750776B1

(12) United States Patent
Contreras

(10) Patent No.: US 10,750,776 B1
(45) Date of Patent: Aug. 25, 2020

(54) FIRE PIPE

(71) Applicant: Olga Contreras, Hallandale, FL (US)

(72) Inventor: Olga Contreras, Hallandale, FL (US)

( * ) Notice: Subject to any disclaimer, the term of this patent is extended or adjusted under 35 U.S.C. 154(b) by 0 days.

(21) Appl. No.: 16/501,747

(22) Filed: Jun. 4, 2019

Related U.S. Application Data

(63) Continuation-in-part of application No. 15/362,825, filed on Nov. 29, 2016, now Pat. No. 10,357,058.

(51) Int. Cl.

| | |
|---|---|
| ***A24F 47/00*** | (2020.01) |
| ***A24F 3/00*** | (2006.01) |
| ***A24F 1/24*** | (2006.01) |
| ***F23Q 2/28*** | (2006.01) |
| ***A24F 1/02*** | (2006.01) |

(52) U.S. Cl.
CPC ..... *A24F 1/24* (2013.01); *A24F 1/02* (2013.01); *F23Q 2/285* (2013.01)

(58) Field of Classification Search
None
See application file for complete search history.

(56) References Cited

U.S. PATENT DOCUMENTS

| | | | | | |
|---|---|---|---|---|---|
| 3,698,400 | A * | 10/1972 | Tucker | A24F 3/00 | 131/185 |
| 3,882,876 | A * | 5/1975 | Covington | A24F 3/00 | 131/185 |
| 4,303,083 | A * | 12/1981 | Burruss, Jr. | A61M 15/06 | 131/194 |
| 4,922,901 | A * | 5/1990 | Brooks | A24F 47/006 | 128/202.27 |
| 2013/0087160 | A1* | 4/2013 | Gherghe | A24F 1/00 | 131/329 |
| 2016/0100628 | A1* | 4/2016 | Garcia | A24F 5/00 | 131/328 |

* cited by examiner

*Primary Examiner* — Cynthia Szewczyk

(57) ABSTRACT

A battery-operated ignition smoking pipe including a replaceable nichrome wire within an indentation on an inner perimeter of a bowl of the pipe body, a fuel reservoir directly below and adjacent the interior cavity of the bowl, an ignition switch on a stem of a pipe body to activate, in one embodiment, a nichrome wire and, and in another embodiment, an ignition wire for igniting an amount of fuel within a fuel reservoir to combust an ignitable smoking substance, such as tobacco, contained within the bowl, and a filter disposed between the stem and the bowl. The present device permits one-handed ignition to combust the smoking substance.

4 Claims, 10 Drawing Sheets

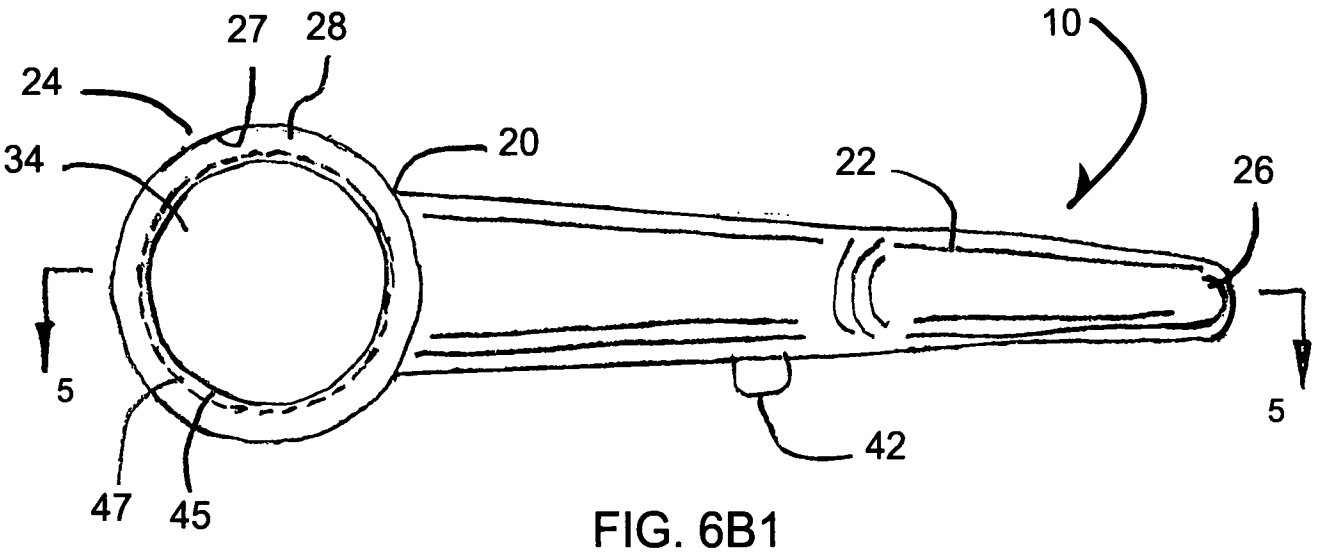
FIG. 6B1
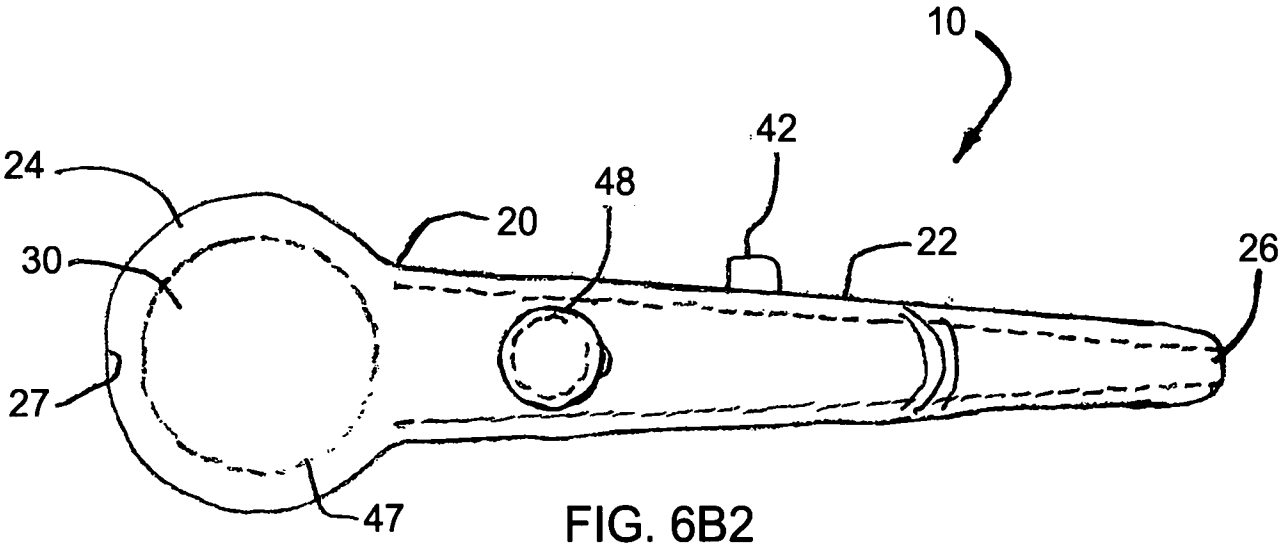
FIG. 6B2

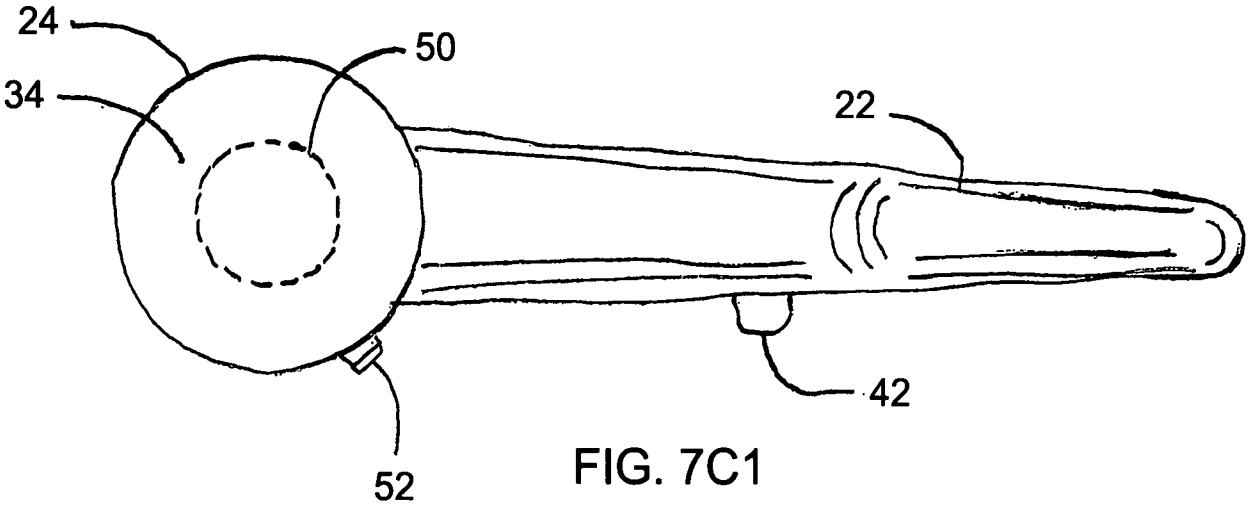
FIG. 7C1
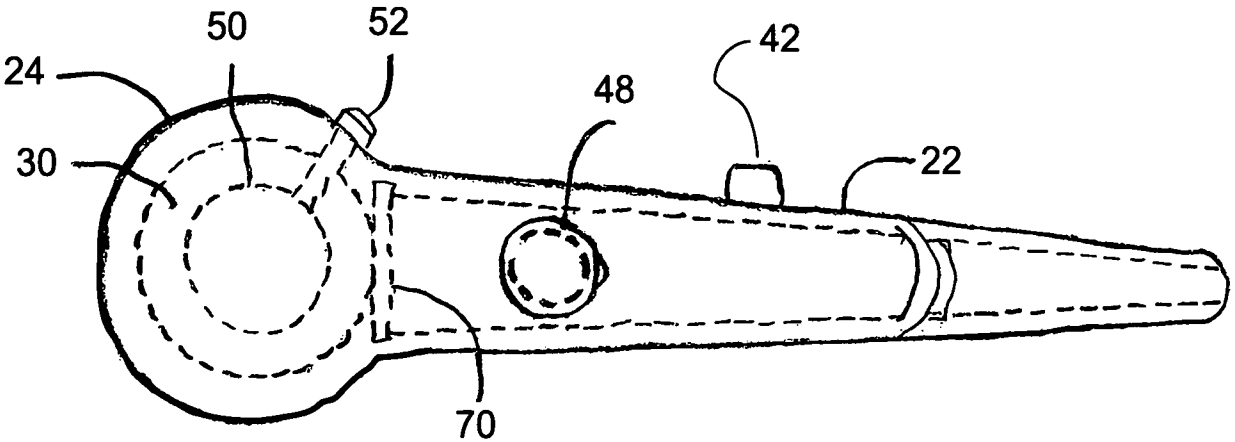
FIG. 7C2

FIRE PIPE

CROSS REFERENCE TO RELATED APPLICATIONS

This application is a divisional of U.S. patent application Ser. No 15/362,825, filed Nov. 29, 2016, which is hereby incorporated by reference in its entirety.

BACKGROUND OF THE INVENTION

Various types of smoking pipes are known in the prior art. However, what is needed and what is provided here in is a battery-operated ignition smoking pipe which provides a replaceable nichrome wire disposed on an inner perimeter of a bowl of the pipe body, a full reservoir disposed directly below and directly adjacent to the bowl, an ignition switch disposed on a stem of a pipe body which selectively activates one of the nichrome wire and amount of fuel within the fuel reservoir to combust an ignitable smoking substance, such as tobacco, disposed within the bowl, and a filter disposed between the stem and the bowl. The present device permits one-handed ignition to combust the smoking substance more easily and faster than is possible with manual ignition of a pipe without the nichrome wire, the fuel reservoir and the ignition switch. In addition, the filter reduces the amount of smoke, any tar present, and fine particles which would otherwise be inhaled during combustion of the smoking substance. The filter further reduces the harshness of the smoke produced when compared to a 23 smoking pipe without the filter.

FIELD OF THE INVENTION

The present invention relates to smoking pipes, and more particularly, to a battery-operated ignition smoking pipe.

SUMMARY OF THE INVENTION

The general purpose of the present battery-operated ignition smoking pipe, described subsequently, in greater detail, is to provide a battery-operated ignition smoking pipe which has many novel features that result in a battery-operated ignition smoking pipe which is not anticipated, rendered obvious, suggested, or even implied by prior art. Either alone or in combination thereof.

To accomplish this, the present battery-operated ignition smoking pipe includes a single construction pipe body having a stem, a bowl, a mouthpiece extending through the stem and in fluid communication with the bowl, and an outer wall of the stem and the bowl. The bowl has a top edge, a bottom end, an interior cavity defined by the top edge, the bottom end, and the outer wall of the bowl, as well as the inner perimeter of the interior cavity. A battery-operated ignition switch is disposed within. The stem has an activation button disposed on the stem. A length of replaceable nichrome wire is removably disposed within a continuous indentation disposed along the inner perimeter proximal the top edge. A battery, disposed within the stem, is in operational communication with the ignition switch. A fuel reservoir, disposed directly below and directly adjacent to the bowl, is configured to contain an amount of fuel, such as a lighter fluid, therein. A refill nozzle on the outer wall of the bowl adjacent the fuel reservoir, is in fluid communication with the fuel reservoir.

An igniter wire is continuously disposed from the ignition switch, to the battery, and encircles the interior cavity. The igniter wire is in operational communication with the length of nichrome wire. The ignition switch is configured to activate the igniter wire and upon activation of the igniter wire, the igniter wire is configured to selectively activate the length of nichrome wire to ignite an ignitable smoking substance, such as tobacco, disposed within the interior cavity of the bowl and alternately directly ignite the amount of fuel within the fuel reservoir to combust the ignitable smoking substance disposed within the interior cavity of the bowl. The smoker, thus, has the option of igniting the smoking substance by placing the nichrome wire within the indention or by placing the amount of fuel within the fuel reservoir through the refill nozzle, followed by pressing the activation button of the ignition switch.

A filter, provided to reduce the amount of smoke, any tar present, and fine particles which would otherwise be inhaled during combustion of the smoking substance and to reduce the harshness of the smoke, is transversely disposed directly between the stem and the bowl. Thus, has been broadly outlined the more important features of the present-operated ignition smoking pipe so that the detailed description thereof that follows may be better understood and in order that the present contribution to the art may be better appreciated.

BRIEF DESCRIPTION OF THE DRAWINGS

Figures

FIG. 6B1 is a top plan view of the second embodiment.
FIG. 6B2 is a bottom plan view of the second embodiment.
FIG. 7C1 is a top plan view of the third embodiment.
FIG. 7C2 is a bottom plan view of the third embodiment.

DETAILED DESCRIPTION OF THE INVENTION

Figure 1:
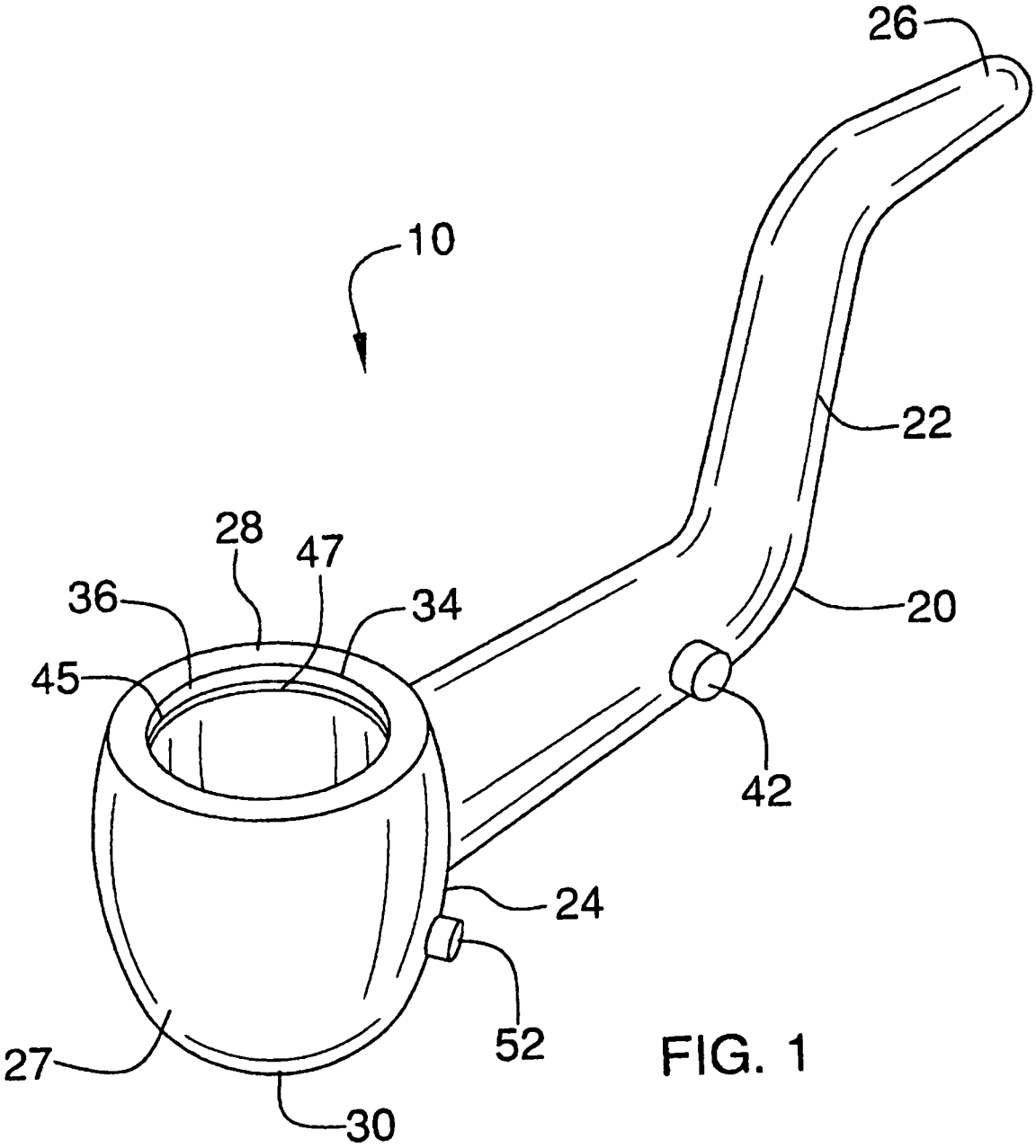
FIG. 1 is a front isometric view.

With reference now to the drawings, and in particular FIGS. 1 through 5 thereof, an example of the instant battery-operated ignition smoking pipe employing the principles and concepts of the present battery-operated ignition smoking pipe and generally designated by the reference number 10 will be described.

Referring to FIGS. 1 through 5 the present battery-operated ignition smoking pipe 10 is illustrated. The battery-operated ignition smoking pipe 10 includes a single construction pipe body 20. The pipe body 20 having a stem 22, a bowl 24, a mouthpiece 26 extending through the stem 22 and in fluid communication with the bowl 24, and an outer wall 27 of the stem 22 and the bowl 24. The bowl 24, has a top edge 28, a bottom end 30, an interior cavity 34 defined by the top edge 28, the bottom end 30, and the outer wall 27 of the bowl 24. The bowl 24 further includes an inner perimeter 36 of the interior cavity 34.

A battery-operated ignition switch, 40 is disposed within the stem 22. The ignition switch 40, has an activation button 42, disposed on the stem 22. A continuous 45 indentation, 45 is disposed along the inner perimeter 34 proximal to the top edge 28. A length of replaceable nichrome wire 47 is removably disposed within the indentation 45. A battery 48 is disposed within the stem 22 and is in operational communication with the ignition switch 40.

A fuel reservoir 50 is disposed directly below and directly adjacent to the interior cavity 34 of the bowl 24 proximal the bottom end 30. The fuel reservoir 50 is configured to contain an amount of fuel, such as lighter fluid, therein. A refill nozzle 52 is accessibly disposed on the outer wall 27 of the bowl 24 adjacent the fuel reservoir 50. The refill nozzle 52 is in fluid communication with the fuel reservoir 50.

An igniter wire, 60 is continuously disposed from the ignition switch 40, to the battery 48, and encircles the interior cavity 34. A first portion 62 of the igniter wire 60 is disposed in a position between the fuel reservoir 50 and the interior cavity 34. A second portion 64 of the igniter wire 60 is disposed between the stem 22 and the interior cavity 34. The igniter wire 60 is in operational communication with the length of nichrome wire 47. The ignition switch, 60 is configured to activate the igniter wire 60. Upon activation of The igniter wire 60, the igniter wire 60 is configured to selectively activate the length of nichrome wire 47 to ignite and ignitable smoking substance, such as tobacco disposed within the interior cavity 34 of the bowl 24 and alternately directly ignite the amount of fuel within the fuel reservoir 50 to combust the ignitable smoking substance disposed within the interior cavity 60 of the bowl 24.

A filter 70 is transversely disposed directly between the stem 22 and the bowl 24. The second portion 64 of the igniter wire 60 Is further disposed between the filter 70 and the interior cavity 34.

The smoker, thus, has the option of igniting the smoking substance within the interior cavity 34 by placing the nichrome wire 47 within the indentation 45 or by placing the amount of fuel within the fuel reservoir 50 through the refill nozzle 52 followed by pressing the activation button 42 of the ignition switch 40.

While the pipe has been disclosed with both the fuel source and nichrome wire above, the invention can be embodied with these features individually as well. Below the pipe is disclosed in a second embodiment with only the fuel source for igniting the smoking substance and in a third embodiment only using the nichrome wire for igniting the smoking substance.

Second Embodiment

Figure 2:
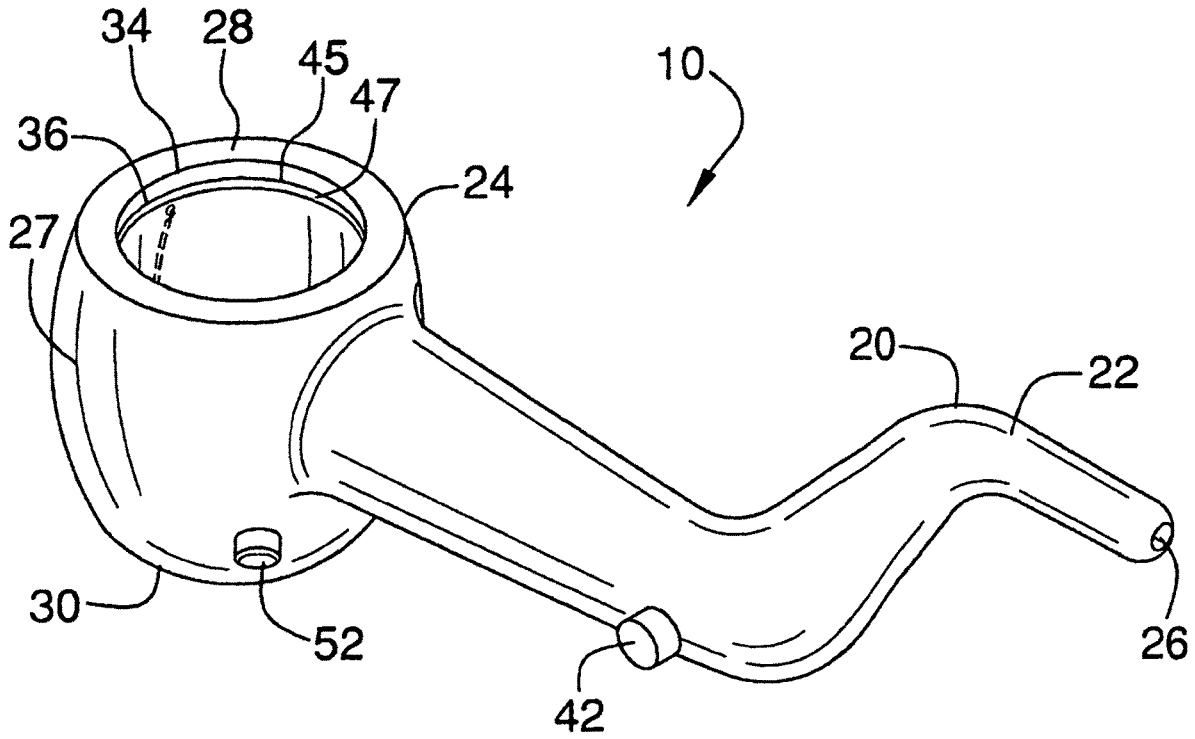
FIG. 2 is a rear isometric view.
Figure 3:
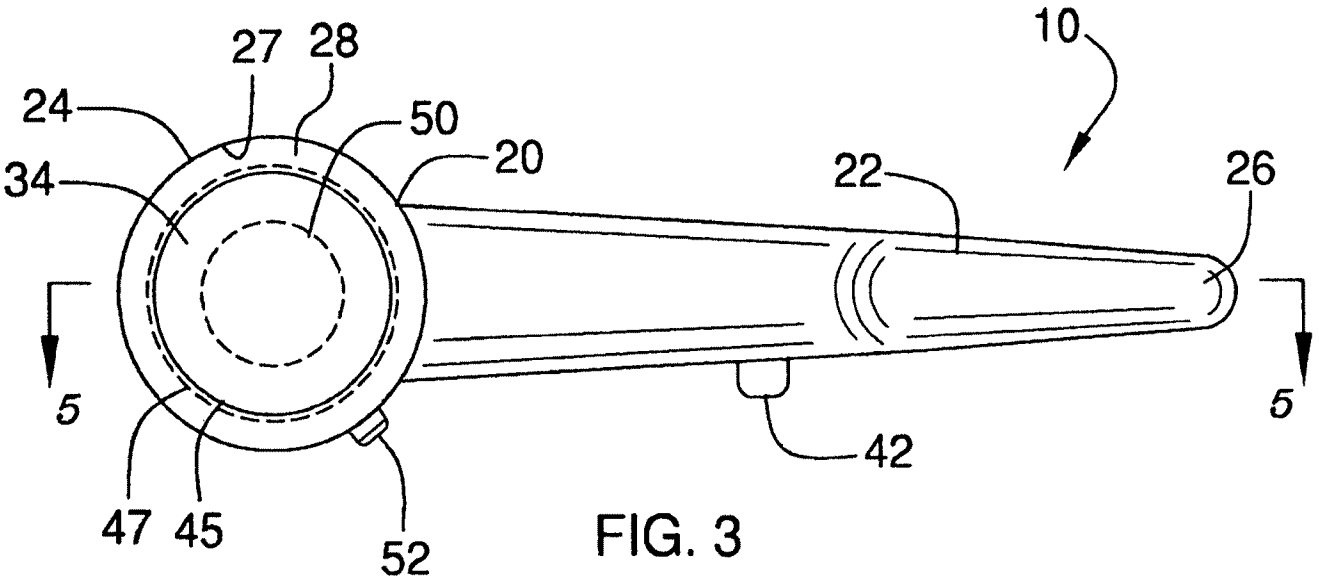
FIG. 3 is a top plan view.
Figure 4:
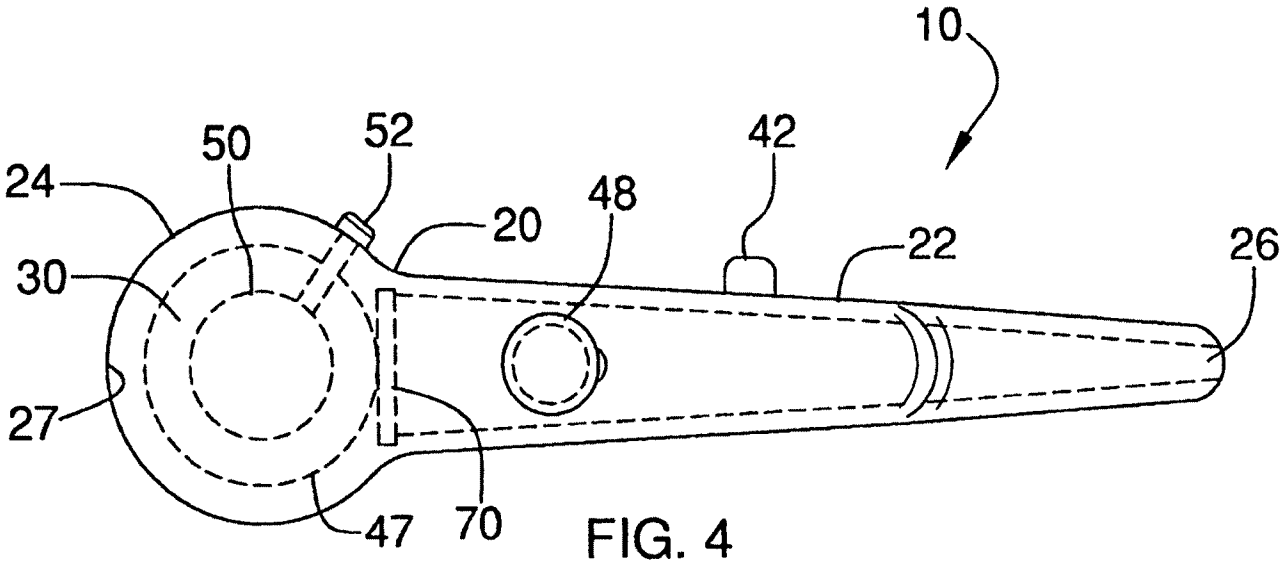
FIG. 4 is a bottom plan view.
Figure 5:
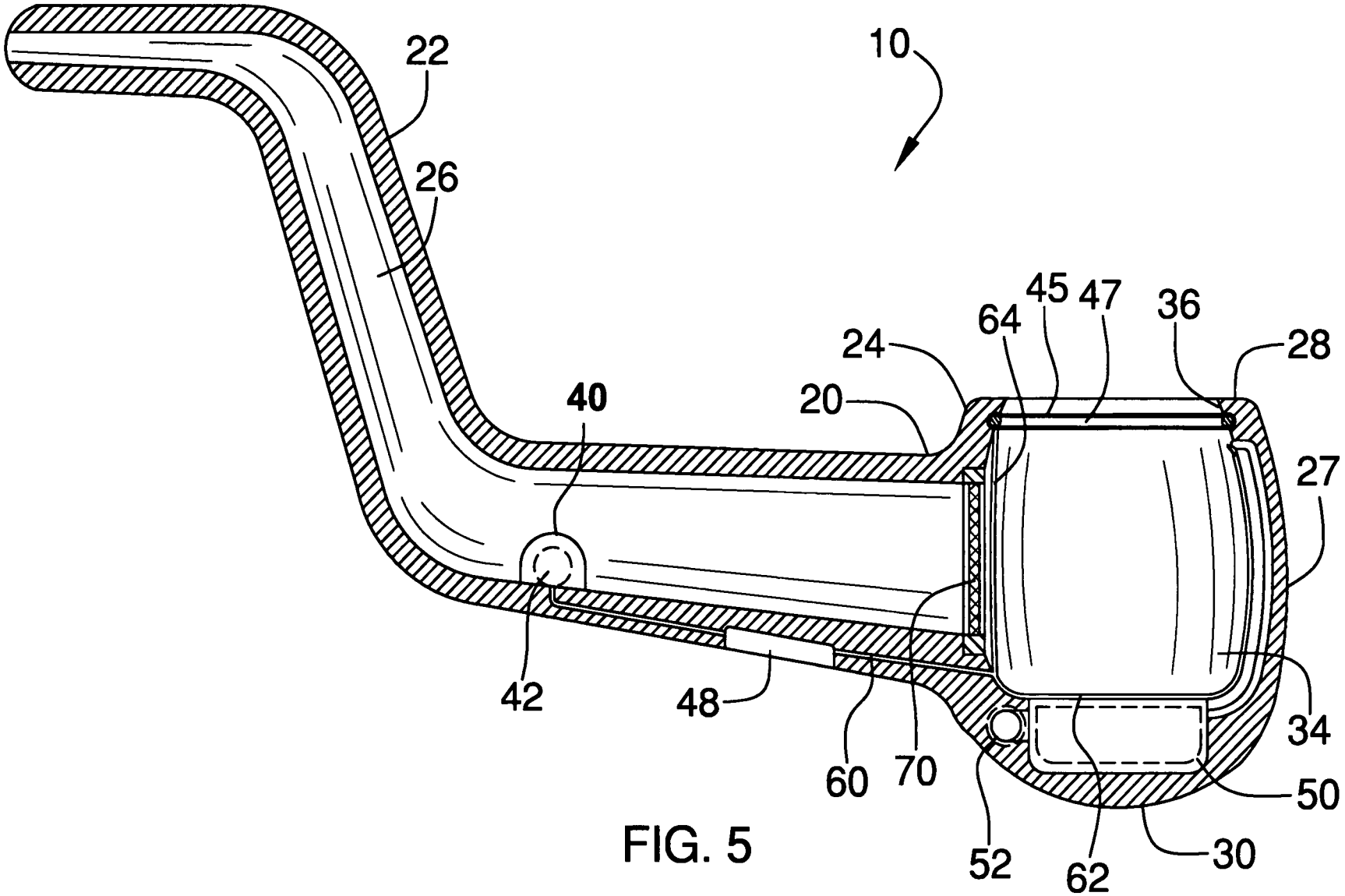
FIG. 5 is a cross-sectional view taken along line 5-5 of FIG. 3.
Figure 6A:
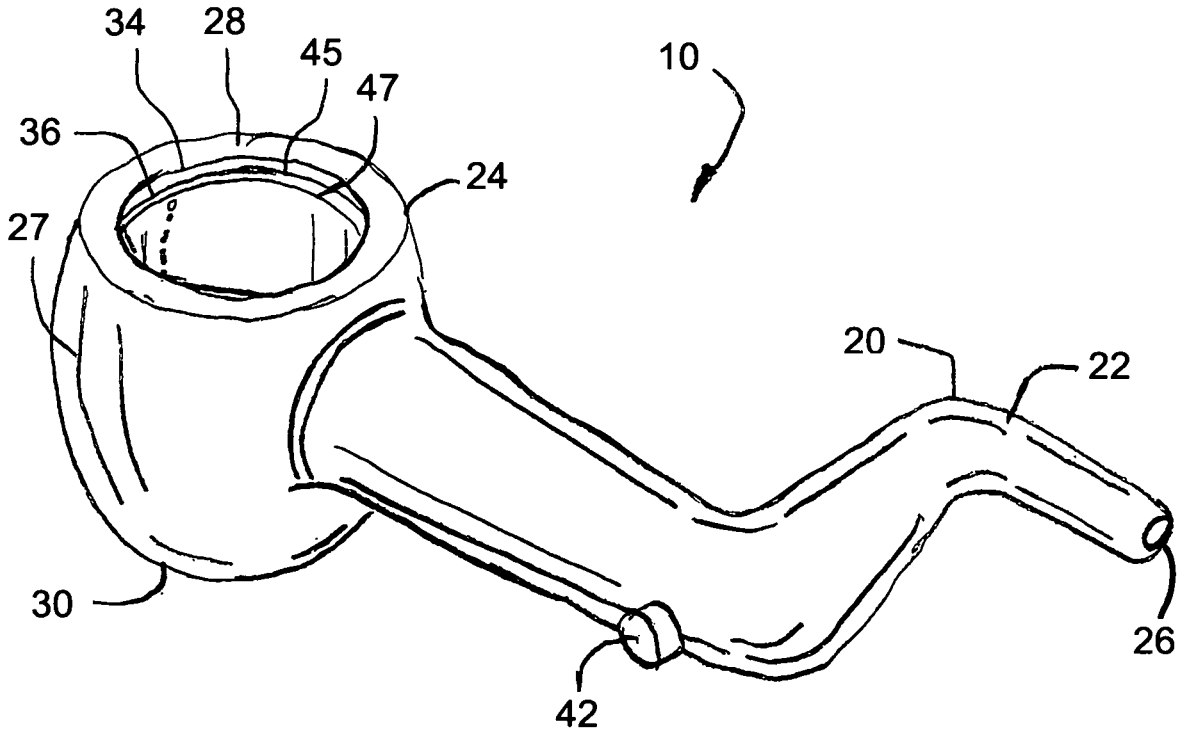
FIG. 6A is a front isometric view of a second embodiment.

With reference to FIGS. 6A-6B2, the second embodiment of the battery operated ignition smoking pipe is disclosed. In the second embodiment, the inventive smoking pipe does not include a fuel source, but instead, only includes the nichrome wire for igniting a smoking substance.

In the second embodiment, the battery operated ignition smoking pipe 10 includes a single construction pipe body 20. The pipe body 20 having a stem 22, a bowl 24, a mouthpiece 26 extending through the stem 22 and in fluid communication with the bowl 24, and an outer wall 27 of the stem 22 and the bowl 24. The bowl 24 has a top edge 28, a bottom end 30, an interior cavity 34 defined by the top edge 28, the bottom end 30, and the outer wall 27 of the bowl 24. The bowl 24 further includes an inner perimeter 36 of the interior cavity 34.

A battery operated ignition switch 40 is disposed within the stem 22. The ignition switch 40 has an activation button 42 disposed on the stem 22. A continuous indentation 45 is disposed along the inner perimeter 34 proximal the top edge 28. A length of replaceable nichrome wire 47 is removably disposed within the indentation 45. A battery 48 is disposed within the stem 22 and is in operational communication with the ignition switch 40.

An igniter wire 60 is continuously disposed from the ignition switch 40, to the battery 48, and encircles the interior cavity 34. A first portion 62 of the igniter wire 60 is disposed at a bottom of the bowl 24 in the interior cavity 34. A second portion 64 of the igniter wire 60 is disposed between the stem 22 and the interior cavity 34. The igniter wire 60 is in operational communication with the length of nichrome wire 47. The ignition switch 60 is configured to activate the igniter wire 60. Upon activation of the igniter wire 60, the igniter wire 60 is configured to activate the length of the nichrome wire 47 to ignite an ignitable smoking substance, such as tobacco, disposed within the interior cavity 34 of the bowl 24 to combust the ignitable smoking substance disposed within the interior cavity 34 of the bowl 24.

A filter 70 is transversely disposed directly between the stem 22 and the bowl 24. The second portion 64 of the igniter wire 60 is further disposed between the filter 70 and the interior cavity 34.

Third Embodiment

Figure 7A:
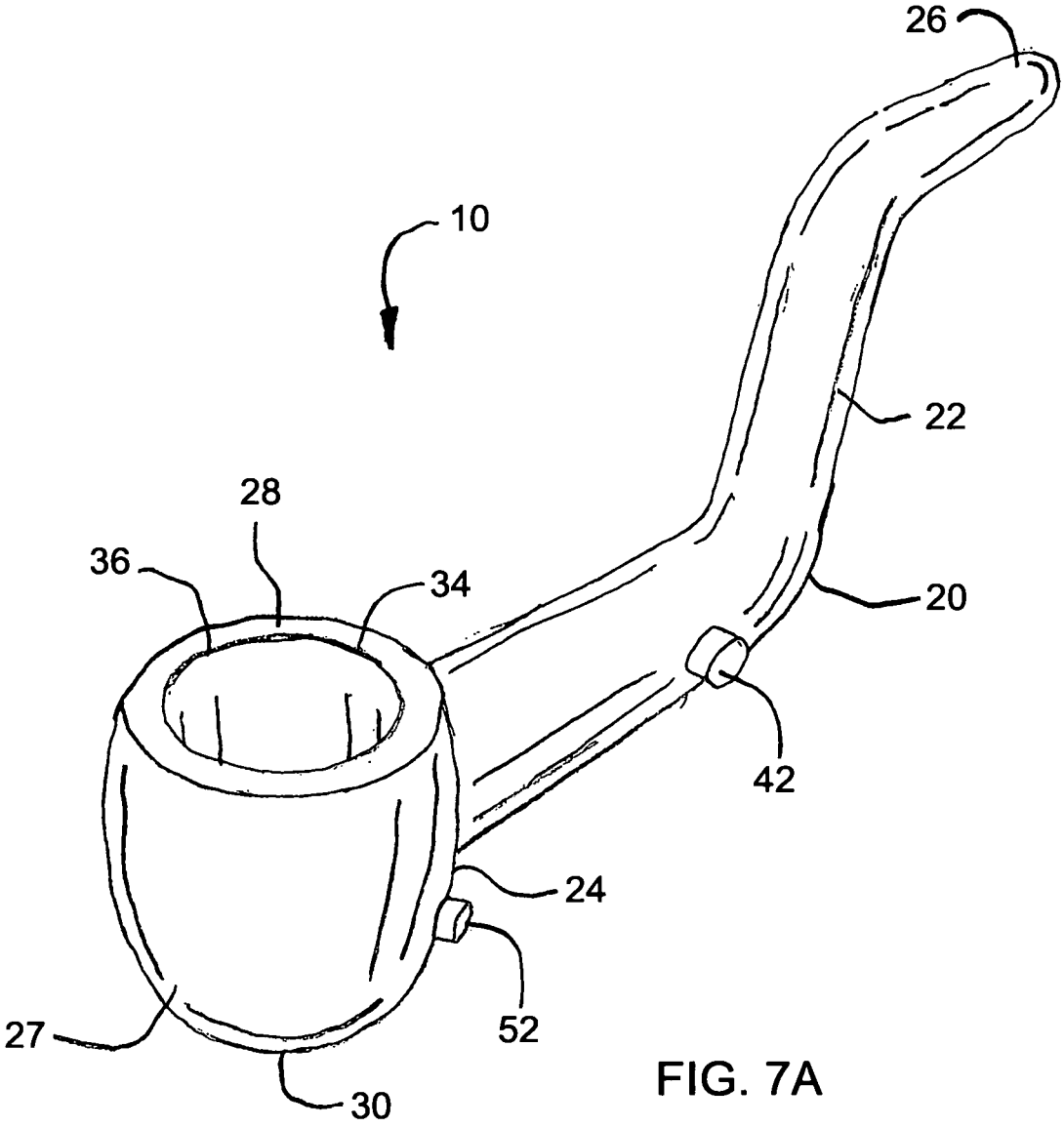
FIG. 7A is a front isometric view of a third embodiment.
Figure 7B:
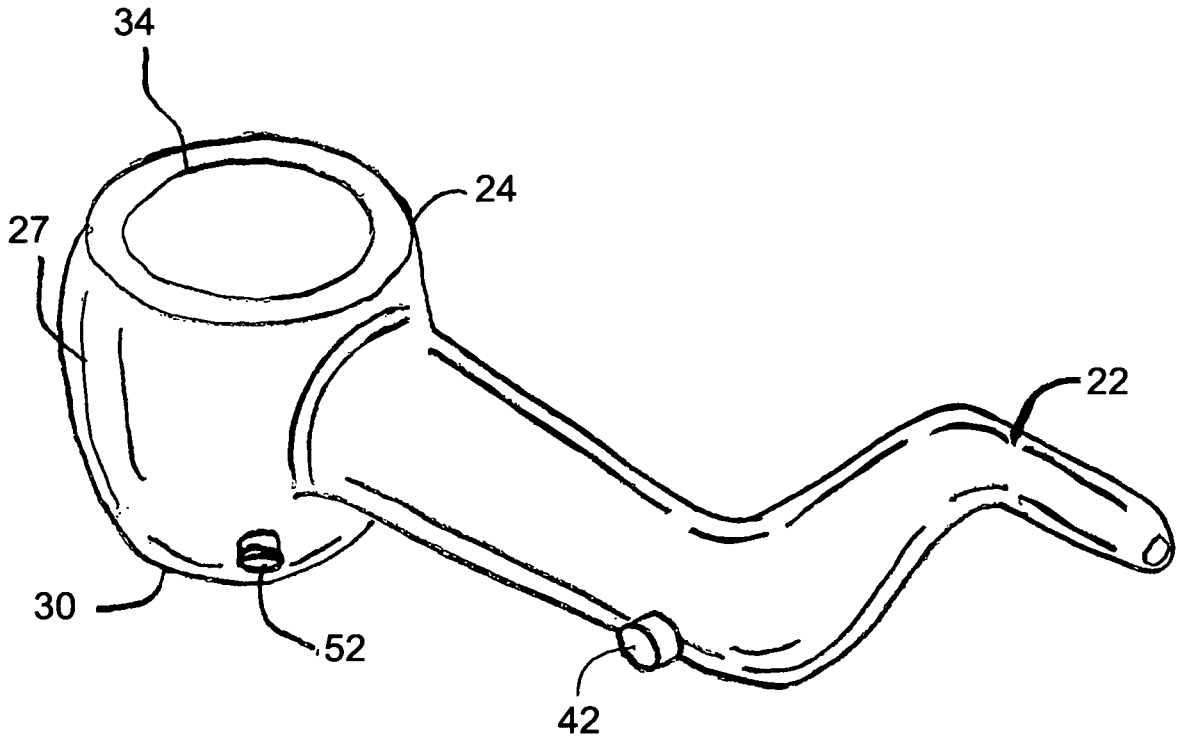
FIG. 7B is a rear isometric view of the third embodiment.
Figure 7D:
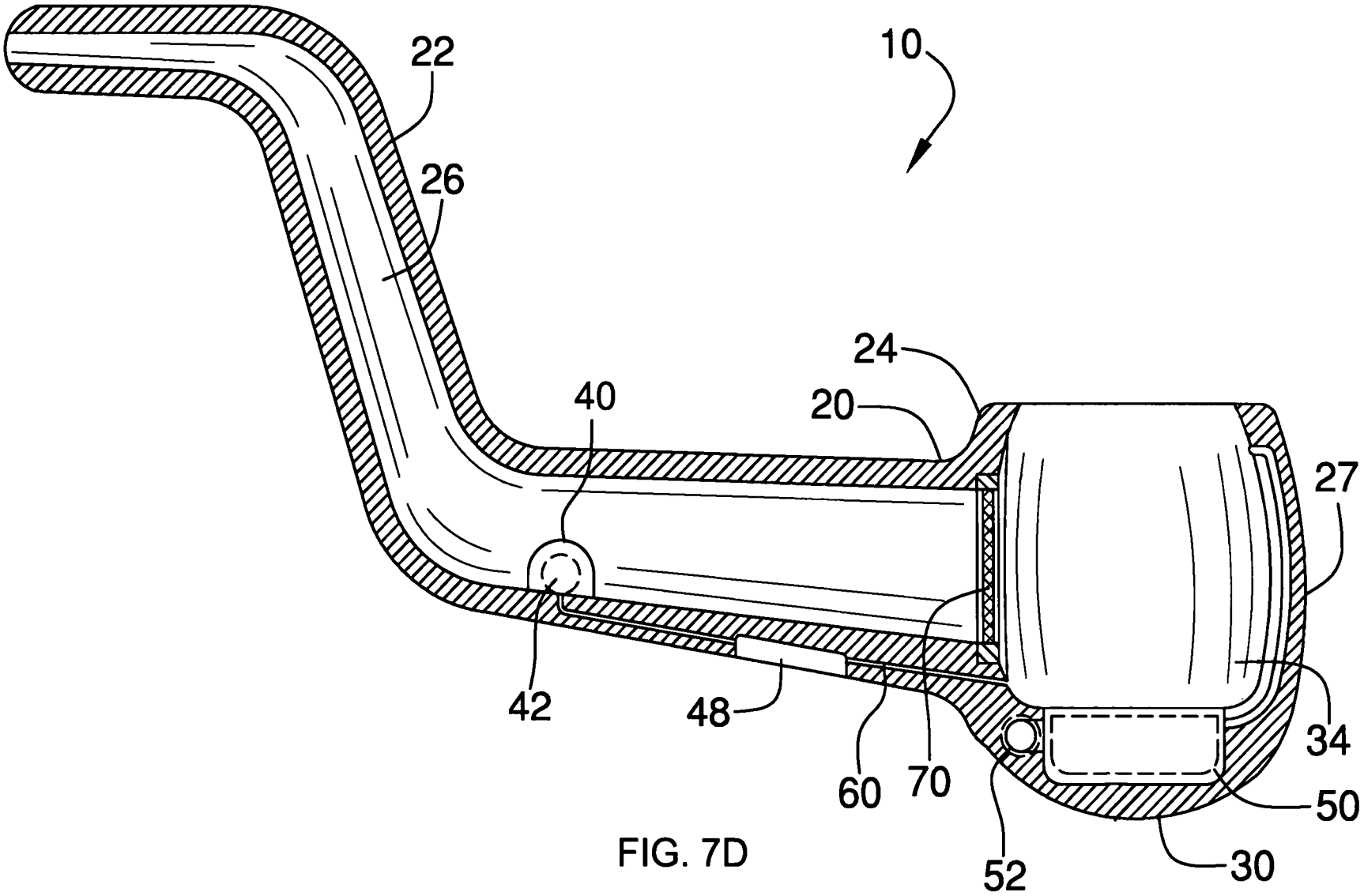
FIG. 7D is a cross-section view of the third embodiment.

With reference to FIG. 7A, a third embodiment of the battery-operated ignition smoking pipe is disclosed. In the third embodiment, the inventive smoking pipe does not include the nichrome wire for igniting the smoking substance, but instead, only includes the fuel for igniting the smoking substance.

In the third embodiment, the battery-operated ignition smoking pipe includes a single construction pipe body having a stem 22, a bowl 24, a mouthpiece 26 extending through the stem 22 in fluid communication with the bowl 24, and an outer wall 27 of the stem 22 and the bowl 24. The bowl 24 has a top edge 28, a bottom end 30, an interior cavity 34 defined by top edge 28, the bottom end 30, and the outer wall 27 of the bowl 34, as well as an inner perimeter 34 of the interior cavity 34.

A battery-operated ignition switch 40 is disposed within stem 22. The ignition switch 40 has an activation button 42 disposed on the stem 22. A battery 48, disposed within the stem 22, is in operational communication with the ignition switch 40.

An igniter wire 60 is continuously disposed from the ignition switch 40, to the battery 48, and ends at the interior cavity 34, near the fuel reservoir 50. The ignition switch 60, is configured to activate the igniter wire 60. Upon activation of the igniter wire 60. The igniter wire 60 is configured to directly ignite the amount of fuel within the fuel reservoir 50 to combust the ignitable smoking substance disposed within the interior cavity 34 of the bowl 24.

A filter 70 is transversely disposed directly between the stem 22 and the bowl 24.

What is claimed is:

1. A battery-operated ignition smoking pipe compromising:

a single construction pipe body having a stem, a bowl, a mouthpiece e tending through, the stem and in fluid communication with the bowl and an outer wall of the stem and the bow, the bowl having a top edge, the bottom end, and the outer wall of the bowl, and an inner perimeter of the interior cavity;

a battery-operated ignition switch disposed within the stem, the ignition switch having an activation button disposed on the stem;

a continuous indentation along the inner perimeter proximal the top edge;

a length of replaceable nichrome wire removeably disposed within the indentation;

a battery disposed within the stem, the battery being in operational communication with the ignition switch;

an ignition wire continuously disposed from the ignition switch, to the battery, encircling the interior cavity, a first portion of the igniter wire disposed in a position between the bottom of the bowl and the interior cavity, a second position of the igniter wire disposed between the stem and the interior cavity, the igniter wire being in operational communication with the length of nichrome wire; wherein upon activate of the ignition wire, the igniter wire is configured to selectively activate the length of the nichrome wire to ignite the ignitable smoking substance disposed within the interior cavity of the bowl to combust the ignitable smoking substance disposed within the interior cavity of the bowl.

2. The battery-operated ignition smoking pipe of claim 1 compromising:

a filter transversely disposed directly between the stem and the bowl; wherein the second portion of the igniter wire disposed between the stem and the interior cavity is further disposed between the filter of the interior cavity.

3. A battery-operated ignition smoking pipe comprising:

a single construction pipe body having a stem, a bowl, and a mouthpiece extending through the stem and in fluid communication with the bowl and an outer wall of the stem and the bowl, the bowl having a top edge, a bottom end, an interior cavity defined by the top edge, the bottom end and the outer wall of the bowl, and an inner perimeter of the interior cavity;

a battery-operated ignition switch disposed within the stem, the ignition switch having an activation button disposed on the stem; a battery disposed within the stem, the battery being in operational communication with the ignition switch;

a fuel reservoir disposed directly below and directly adjacent to the interior cavity of the bowl proximal the bottom end, wherein the fuel reservoir is configured to contain an amount of fuel therein;

a refill nozzle accessible on the outer wall of the bowl in a position adjacent the fuel reservoir, the refill nozzle being:

in fluid communication with the fuel reservoir; and an igniter wire continuously disposed from the ignition switch, to the battery, in from the battery to a bottom of the bowl adjacent the fuel reservoir;

wherein the ignition switch is configured to activate the igniter wire;

wherein upon activation of the igniter wire, the igniter wire is configured to directly ignite the amount of fuel within the fuel reservoir to combust an ignitable smoking substance disposed within the interior cavity of the bowl.

4. The battery-operated ignition smoking pipe of claim 3 further comprising:

a filter transversely disposed directly between the stem and the bowl.

* * * * *